US005738598A

United States Patent [19]

Wu

[11] Patent Number: 5,738,598

[45] Date of Patent: Apr. 14, 1998

[54] STRUCTURE OF TEE FOR GOLF

[76] Inventor: Ching-Chang Wu, No. 35-1, Jih Hsin Street, Tu Cheng Hsiang, Taipei Hsien, Taiwan

[21] Appl. No.: 815,705

[22] Filed: Mar. 12, 1997

[51] Int. Cl.[6] ..... A63B 57/00

[52] U.S. Cl. ..... 473/392; 473/402

[58] Field of Search ..... 473/387, 388, 473/389, 392, 393, 394, 395, 396, 398, 400, 401, 402, 403, 408

[56] References Cited

U.S. PATENT DOCUMENTS 4,205,841 6/1980 Silva ..... 473/392

4,838,285 6/1989 Petrone ..... 473/387

5,193,803 3/1993 Flick, III ..... 473/392

5,588,448 12/1996 Photakis ..... 473/402

*Primary Examiner*—Steven B. Wong

*Attorney, Agent, or Firm*—Varndell Legal Group

[57] ABSTRACT

A tee for golf, including projecting guide strip raised from the head of the tee body thereof and terminating in a forked tail adapted for guiding the striking and for serving as hand tool for loosening and flattening the soil.

2 Claims, 3 Drawing Sheets

STRUCTURE OF TEE FOR GOLF

BACKGROUND AND SUMMARY OF THE INVENTION

The present invention relates to a tee for golf, and more particularly to such a tee that has a projecting guide strip raised from the periphery of the head thereof, and which adapted for guiding the striking.

A regular tee for golf, as shown in FIG. 1, is designed for supporting a golf ball for striking. The regular golf tee has a pointed tip by which the tee can be conveniently secured in the ground. Before securing the tee in the ground, the player may have to use a hand tool to loosen and flatten the soil. Therefore, when playing golf, the golfer may have to carry a hand tool for loosening and flattening the soil. Further, a smoker may be unable to stop from smoking when playing golf. However, it is difficult to find a place for carrying a burning cigarette when playing golf.

The present invention has been accomplished to provide a tee for golf which can be used as a guide means for guiding the striking, hand tool means for loosening and flattening the soil, as well as a support means for supporting a burning cigarette or cigar. According to one aspect of the present invention, the tee has a projecting guide strip raised from the periphery of the head thereof and terminating in a forked tail for guiding the striking of a golf ball and for use as hand tool means for loosening and flattening the soil. According to another aspect of the present invention, the projecting guide strip has two raised portions at the top adapted to be acted with the forked tail to hold a cigarette or cigar.

DETAILED DESCRIPTION OF THE PREFERRED EMBODIMENT

Figure 1:
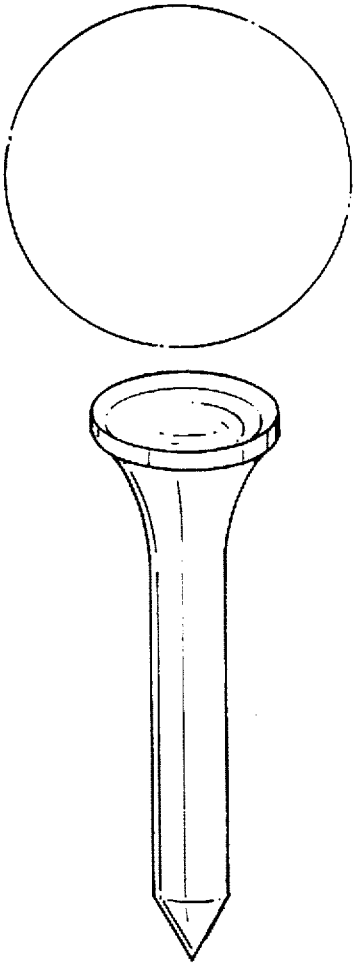
Fig. 1 PRIOR ART
FIG. 1 shows a tee for golf according to the prior art.
Figure 2:
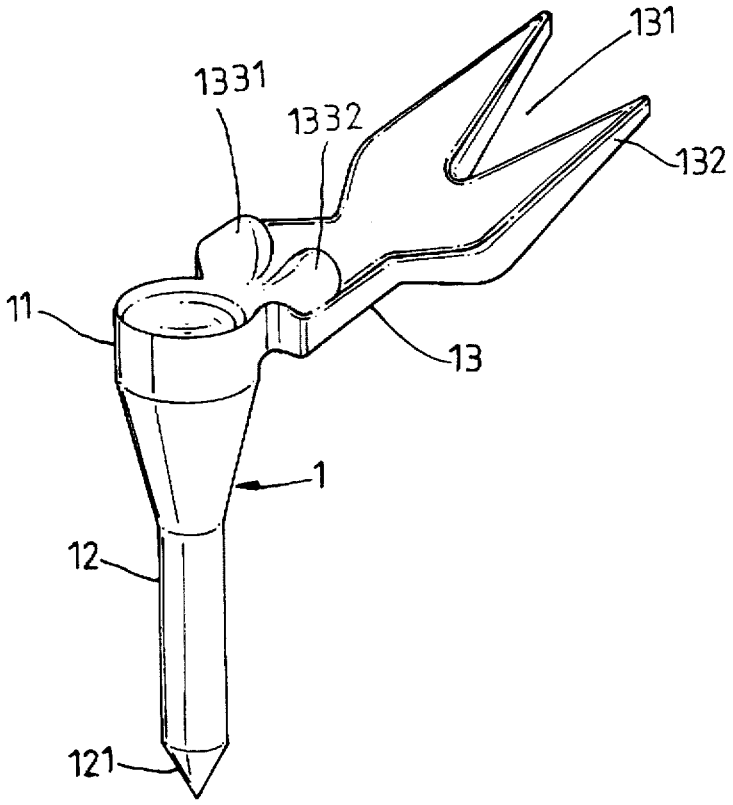
FIG. 2 is an elevational view of a tee for golf according to the present invention.
Figure 3:
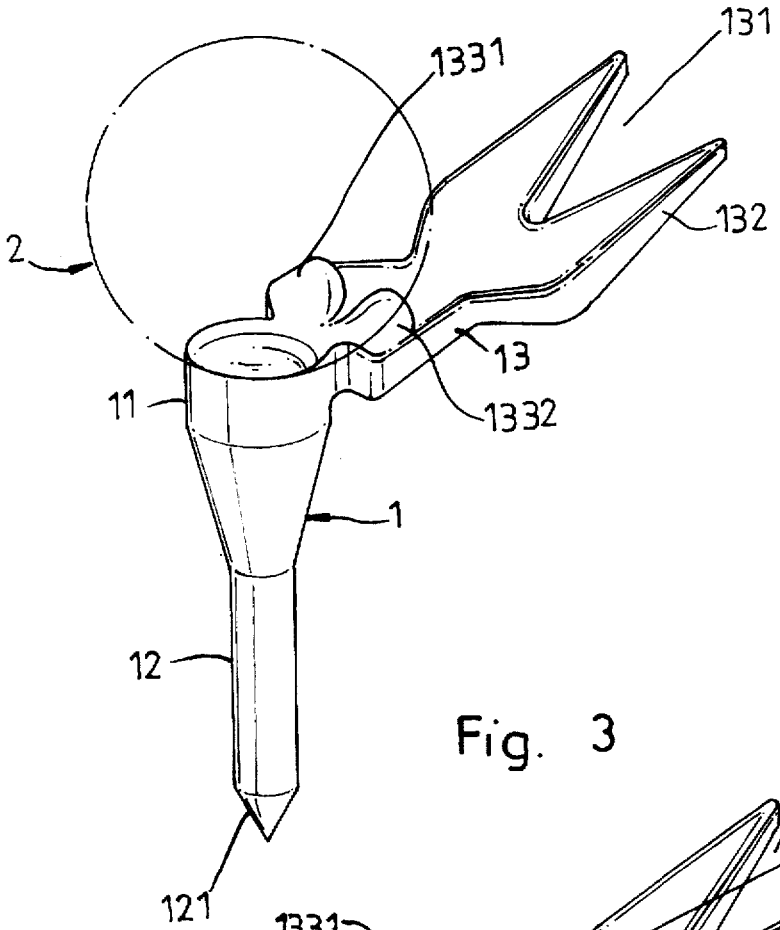
FIG. 3 is an applied view of the present invention, showing a golf ball supported on the head of the shank.

Referring to FIGS. 2 and 3, the tee 1, comprises a cylindrical shank 12 having a bottom end terminating in a pointed tip 121 for fastening to the ground and a top end terminating in a head 11 for receiving the golf ball 2, the top including a recessed cylindrical opening including a cylindrical rim at an uppermost portion thereof and a truncated cone shaped solid structure arranged between the top and the cylindrical shaft and a projecting guide strip 13 raised from the periphery of the head 11 of the shank 12, and extending outwardly from the top relative to the cylindrical opening for guiding the striking angle. The projecting guide strip 13 has a notch 131 at the tail defining a forked portion 132 and two smoothly curved raised portions 1331; 1332 disposed at the top side adjacent to the head 11 of the shank 12 and intersecting the cylindrical rim. The forked portion 132 slightly curves upwards and is adapted for guiding the striking direction. The forked portion defines two prongs including pointed ends extending in a direction away from the cylindrical opening, the two prongs forming a V-shaped notch therebetween. The cylindrical rim and the two smoothly curved raised portions are adapted to hold a golf ball. Because of the design of the projecting guide strip 13, the tee 1 can be used as hand tool means for loosening and flattening the soil before it is secured in to the soil.

Figure 4:
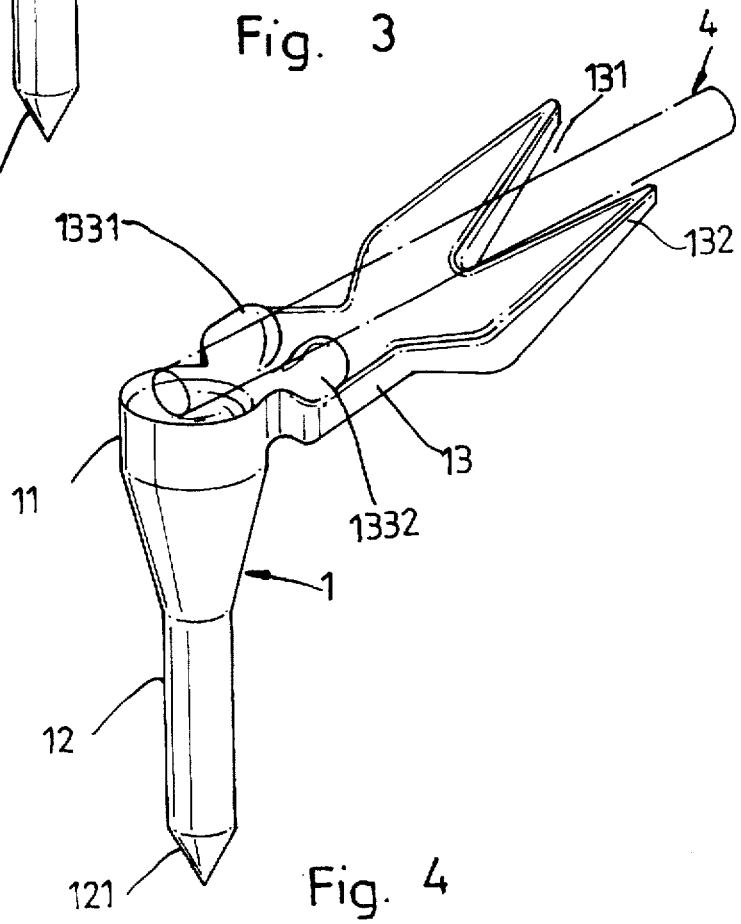
FIG. 4 is another applied view of the present invention, showing a cigarette carried on the projecting guide strip.

Referring to FIG. 4, when the tee 1 is fastened to the ground, it can also be used as a support means for supporting a cigarette or cigar 4, permitting one end of the cigarette or cigar 4 to be rested in between the raised portions 1331; 1332 and the other end thereof to be carried on the prongs.

I claim:

1. A golf tee comprising a cylindrical shaft having a bottom end terminating in a pointed tip for positioning the golf tee in soil, a top including a recessed cylindrical opening including a cylindrical rim at an uppermost portion thereof, a truncated cone shaped solid structure arranged between the top and the cylindrical shaft, and a projecting guide strip extending outwardly from the top relative to the cylindrical opening, the projecting guide strip having two smoothly curved raised portions intersecting the cylindrical rim, and two prongs including pointed ends extending in a direction away from the cylindrical opening, the two prongs forming a V-shaped notch therebetween, the cylindrical rim and the two smoothly curved raised portions adapted to hold a golf ball; and the two prongs and the two smoothly curved raised portions adapted for holding a cigarette, guiding a struck gold ball and loosening and flattening the soil.

2. A golf tee consisting of a cylindrical shaft having a bottom end terminating in a pointed tip for positioning the golf tee in soil, a top including a recessed cylindrical opening including a cylindrical rim at an uppermost portion thereof, a truncated cone shaped solid structure arranged between the top and the cylindrical shaft, and a projecting guide strip extending outwardly from the top relative to the cylindrical opening, the projecting guide strip having two smoothly curved raised portions intersecting the cylindrical rim, and two prongs including pointed ends extending in a direction away from the cylindrical opening, the two prongs forming a V-shaped notch therebetween, the cylindrical rim and the two smoothly curved raised portions adapted to hold a golf ball; and the two prongs and the two smoothly curved raised portions adapted for holding a cigarette, guiding a struck golf ball and loosening and flattening the soil.

* * * * *